US010227834B2

(12) United States Patent
Fischer et al.

(10) Patent No.: US 10,227,834 B2
(45) Date of Patent: Mar. 12, 2019

(54) DRIVE OF AN EARTH DRILLING DEVICE, EARTH DRILLING DEVICE, AND A METHOD FOR DRIVING AN EARTH DRILLING DEVICE

(71) Applicant: TRACTO-TECHNIK GmbH & Co. KG, Lennestadt (DE)

(72) Inventors: Sebastian Fischer, Lennestadt (DE); Gerhard Völkel, Erndtebrück (DE); Christian Löher, Eslohe (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 151 days.

(21) Appl. No.: 14/957,001

(22) Filed: Dec. 2, 2015

(65) Prior Publication Data

US 2016/0160584 A1 Jun. 9, 2016

(30) Foreign Application Priority Data

Dec. 5, 2014 (DE) ..... 10 2014 018 101

(51) Int. Cl.

| | |
|---|---|
| ***E21B 19/08*** | (2006.01) |
| ***E21B 7/04*** | (2006.01) |
| ***E21B 19/084*** | (2006.01) |
| ***E21B 19/086*** | (2006.01) |

(52) U.S. Cl.

CPC ..... *E21B 19/08* (2013.01); *E21B 7/046* (2013.01); *E21B 19/084* (2013.01); *E21B 19/086* (2013.01)

(58) Field of Classification Search

CPC ..... E21B 19/08; E21B 19/084; E21B 19/086; E21B 7/046

USPC ..... 173/11, 19, 148, 151, 152

See application file for complete search history.

(56) References Cited

U.S. PATENT DOCUMENTS

| | | | | |
|---|---|---|---|---|
| 3,089,550 | A | 5/1963 | Watson | |
| 3,149,540 | A | 9/1964 | Lindgren et al. | |
| 3,613,804 | A * | 10/1971 | Jonsson | E21B 3/02 173/147 |
| 3,741,315 | A | 6/1973 | Hilton | |
| 3,835,940 | A * | 9/1974 | Winter, Jr. | E21B 7/02 173/147 |
| 4,172,411 | A * | 10/1979 | Matsuda | B25D 9/12 91/278 |
| 4,456,077 | A * | 6/1984 | Lagerstedt | E21B 19/084 173/147 |
| 6,267,187 | B1 | 7/2001 | Puettmann et al. | |
| 2010/0139941 | A1 | 6/2010 | Piipponen | |

FOREIGN PATENT DOCUMENTS

| | | |
|---|---|---|
| DE | 2064862 A1 | 7/1971 |
| EP | 0065507 A2 | 11/1982 |
| EP | 0065507 B1 | 1/1986 |
| EP | 0886034 A2 | 12/1998 |

(Continued)

*Primary Examiner* — Nicole Coy
*Assistant Examiner* — Yanick A Akaragwe
(74) *Attorney, Agent, or Firm* — Howard IP Law Group

(57) ABSTRACT

A drive of a slide which can move back and forth of an earth drilling device to move a drill string, wherein a rod, which can move relative to a cylinder, and tension transmitting means are provided in a frame and act on the slide, wherein the rod is connected to the frame, and deflection rollers are provided for the tension transmitting means on the frame and on the cylinder.

16 Claims, 2 Drawing Sheets

(56) References Cited

FOREIGN PATENT DOCUMENTS

| | | | |
|---|---|---|---|
| GB | 1344821 | | 1/1974 |
| SU | 1507951 | A1 | 9/1989 |
| WO | 2008/044996 | A1 | 4/2008 |

* cited by examiner

DRIVE OF AN EARTH DRILLING DEVICE, EARTH DRILLING DEVICE, AND A METHOD FOR DRIVING AN EARTH DRILLING DEVICE

CROSS-REFERENCE TO RELATED APPLICATIONS

This application claims priority pursuant to 35 U.S.C. 119(a)-(d) to German Application No. 10 2014 018 101.4 filed Dec. 5, 2014, the subject matter incorporated herein by reference.

FIELD OF INVENTION

The invention relates to a drive for an earth drilling device to move a drill string, an earth drilling device, as well as a method for driving a slide to move a drill string of an earth drilling device.

BACKGROUND

Earth drilling devices, in particular horizontal drilling devices, are used to introduce earth drill holes into the soil by trenchless construction for supply and waste lines, for example, or to replace already installed old lines without a trench. To introduce the earth drill hole, generally a drill string having drill string sections is used, wherein the drill string sections are connectable to each other.

The use of a slide that can be moved back and forth in a frame for advancing and/or retracting a drill string is known from EP 0 886 034 B1, for example. The slide has a seat for a drill string section such that the drill string section can be moved in the seat in the direction of a feed axis to create the earth drill hole. The drive acting on the drill string section can act on the drill string section in the seat in a rotational and/or translatory manner.

The drive for moving the slide in the frame can be moved by means of a rack, which is securely connected to the frame, and a hydraulic motor that has toothed wheel which is mounted on the slide. Furthermore, a cylinder packet consisting of adjacent cylinders can be used.

It is furthermore known from DE 20 64 862 to move a platform by means of cables and a pulley or rollers. The cable is placed over a rotatable roller which is borne by a holder on an end of the cantilever and is guided running along the cantilever about another roller which is returned along the cantilever by means of a holder that is held on a piston of a dual-acting hydraulic ram.

A disadvantage of the method known from the prior art is that the full release of power is not transmitted in small advances, which is the case in particular with cylinder packets consisting of a plurality of adjacent cylinders. Furthermore, the high cost is disadvantageous. Use in a trench is not optimum since the construction is too bulky, and/or a desired useful drill string length is not achieved.

SUMMARY

An object of the invention was therefore to present an improved drive for an earth drilling device which is improved in comparison to at least one of the aforementioned disadvantages. In particular, a compact design was to be achievable with an increased useful drill string length.

A key concept of the invention is to combine an element which can be extended relative to another element, and the use of tension transmitting means in the manner of a pulley, wherein deflection rollers for the tension transmitting means of the pulley are arranged on the element, which is the element from which the other element extends.

The drive for a slide which can be moved back-and-forth of a drilling device to move a drill string has a rod which can be moved in a frame relative to a cylinder, and tension transmitting means which act on the slide. The rod is connected to the frame, and deflection rollers for the tension transmitting means are provided on the frame and on the cylinder. The construction is simple and economical, wherein a high level of efficiency is achievable even at very slow speeds of slide movement. In addition, by attaching the deflection rollers for the tension transmitting means to the cylinder, installation space is saved which can enable a compact drive construction.

An "earth drilling device" is in particular understood to be any device that moves a drill string having drill string sections within a channel that exists or is to be created in the soil in order to create or expand a hole, in particular a horizontal drill hole (HD), or to pull lines or other long bodies into the soil. The earth drilling device can in particular be a HD device. An "earth drilling device" according to the invention comprises a device that drives a drill string and works by displacing soil, and introduces the drill string into the soil in a rotating and/or translatory manner in the direction of the longitudinal axis of the drill string.

According to the present invention, the term "HD" (horizontal drilling) comprises in particular any type of preferably horizontal channels in a body that exist or are to be created, in particular earth channels including earth drill holes, rock drill holes or ground lines as well as underground or above-ground pipelines and water channels that can be produced or pulled in by using a corresponding earth drilling device.

With regard to the subsequently referenced noun, the term "at least one" used in the claims or the description, as well as the indefinite article "a" used in the claims or the description, and the corresponding grammatical forms in terms of gender and declension, are precisely one or more, i.e., two, three, four, etc. of the elements designated by the noun.

According to the invention, the term "slide" indicates a body with a seat for a drill string section, wherein the drill string section can be driven in a translatory and/or rotating manner by means of the drill string section seat. In particular, the slide within the frame can be guided along a path for a translatory movement. The slide can lie on a support that is connected to the frame and has resting elements. The support can be profiled, and the resting elements can be designed as rollers. Skids are also possible as the resting elements. The slide can be guided suspended and/or lying on the frame. The slide can thus be a machine element that can be moved along a path, in particular in a purely translatory manner, within the frame.

According to the invention, the term "frame" comprises a box-shaped or cube-shaped structure whose side walls and/or braces or rods can transfer pressure, traction as well as bending. The frame according to invention preferably has a rectangular outline and can be arranged in a trench for creating the earth drill hole. Preferably, the drive unit and slide are arranged in the frame. In order to fix the device in the trench, the frame can be provided with horizontally extendable braces by means of which the recoil forces can be conducted into the soil.

In one preferred embodiment, the cylinder is a hydraulic cylinder, and the rod is a piston rod on the hydraulic cylinder so that an economical hydraulic cylinder can be used. A hydraulic cylinder can be put to good use under the harsh conditions that exist when drilling in the earth. Hydraulic fluid and pumps required for operation are economical to use.

Preferably, the tension transmitting means—tensile means for short—is a rope or chain, whereby simply designed, stable tension transmitting means can be used which can be selected according to the respective requisite demands.

One end of the tension transmitting means is preferably fastened to the frame, whereby attachment to a particularly stable component contributes to the stability of the drive.

The invention also establishes an earth drilling device with a slide arranged in a frame for advancing a drill string and a rod which can be extended relative to a cylinder, wherein tension transmitting means are attached to the slide to move the slide. The rod is connected to the frame, and tension transmitting means are guided by deflection rollers mounted on the frame and on the cylinder.

In one special embodiment, the deflection rollers mounted on the cylinder are securely arranged with their rotary shaft on the cylinder. In this context, a dual-acting standard cylinder can be used since the drive can be aligned or oriented such that less force is necessary for advancement in the direction of drilling in the earth (piston annulus as the effective surface) than for withdrawal (entire piston surface as the effective surface). Such a cylinder is termed a "differential cylinder" which only has one piston rod and thus one piston surface and a smaller piston annulus. Greater force can thereby be provided for the power infeed. Whereas with a so-called "synchronized cylinder" the impinged upon surfaces are generally the same size in both strokes and the generated force is accordingly also the same size, this differs in the above-cited manner with a differential cylinder.

By suitably choosing the diameter of the deflection rollers on the cylinder relative to the diameter of the cylinder rollers which are fastened to the frame, tension transmitting means can be guided past each other. The rollers arranged on the cylinder preferably have a smaller diameter than the deflection rollers mounted on the frame; in particular, a diameter ratio of 1:1.3 to 1:1.7, and particularly preferably 1:1.5, can be selected.

The invention also establishes a method for driving a slide arranged in a frame for moving a drill string of an earth drilling device, wherein the method comprises the following steps: Moving a deflection roller mounted on a cylinder relative to a rod that is fastened to the frame and mounted in the cylinder; and applying tension to a tension transmitting means guided over the deflection roller and impinging upon the slide.

The above statements, and likewise the following description of exemplary embodiments, do not constitute a relinquishment of specific embodiments or features.

BRIEF DESCRIPTION OF THE DRAWINGS

The invention is explained in greater detail below based on an exemplary embodiment shown in the drawings.

In the drawings.

DETAILED DESCRIPTION OF PREFERRED EMBODIMENTS

Figure 1:
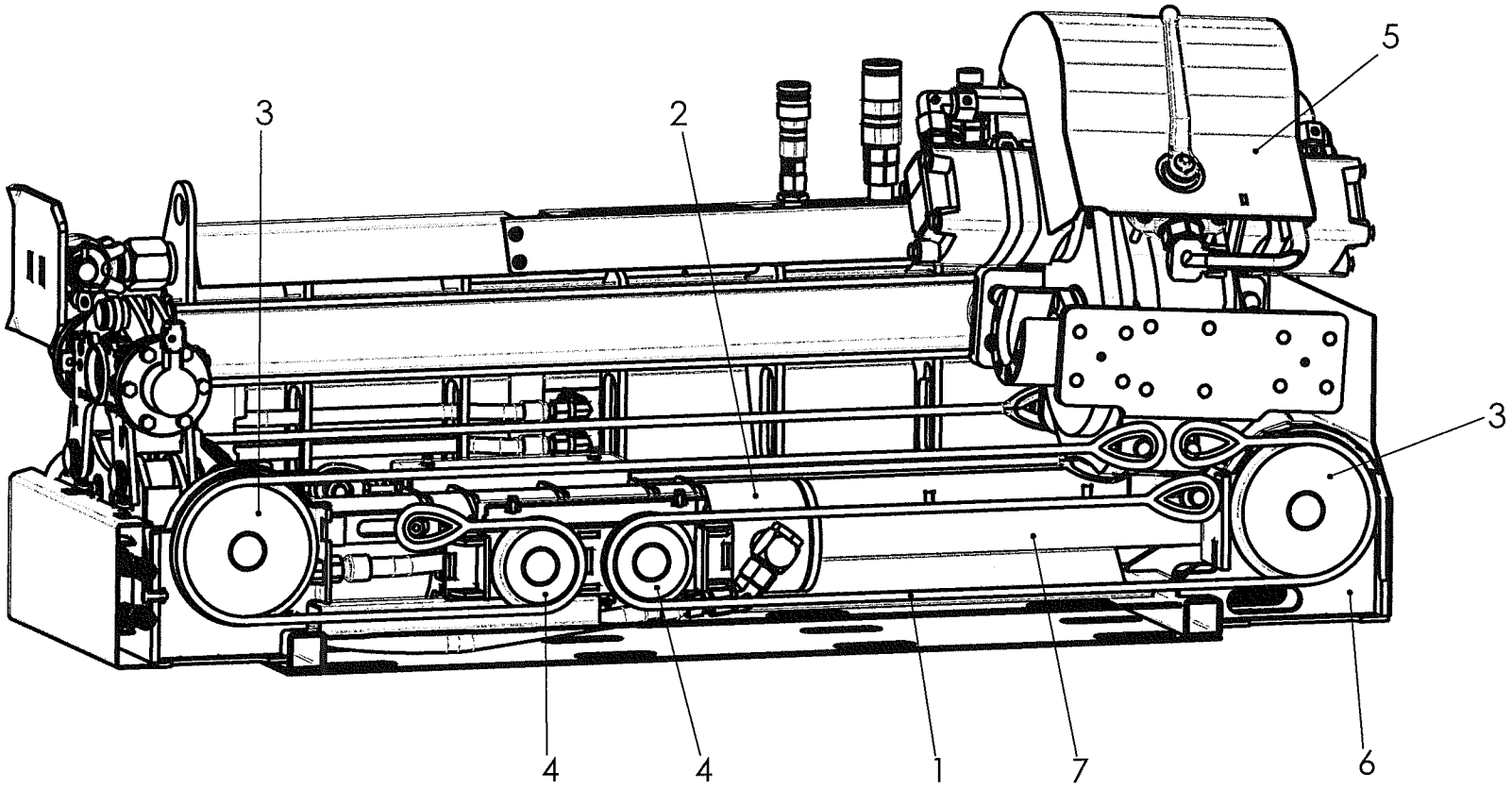
FIG. 1 shows an isometric representation of an earth drilling device obliquely from the side.

FIG. 1 shows an earth drilling device for creating an earth drill hole. The earth drilling device has a slide 5 which can move back and forth in a frame 6 and which lies against a support. The support is designed and profiled as a guide for resting elements of the slide 5.

A rod 7 which is movable relative to a cylinder 2 define an actuator for driving the slide 5 which can be moved back and forth. The cylinder 2 is a dual acting cylinder by means of which work can be performed in both directions. The end of the rod 7 is fastened to the frame 6.

The drive furthermore comprises tension transmitting means 1 in the form of cables. Two tension transmitting means 1 impinge upon the slide on each side in both directions of movement of the slide 5. Each tension transmitting means 1 is guided over a deflection roller 3 attached to the frame 6 and over a deflection roller 4 attached to the cylinder 2. In each case, the other end of the tension transmitting means 1 is connected securely to the frame 6. Four tension transmitting means 1 are provided, two on each side of the slide 5.

It can be seen in FIG. 1 that two deflection rollers 4 are arranged on the side of the cylinder 2 in each case. The pairs of deflection rollers 4 lie opposite each other. The two deflection rollers 4 of one side are arranged adjacent to each other. As can be seen in FIG. 1, the rotary axes of the two deflection rollers 4 of one side run parallel offset from each other. It can also be seen in FIG. 1 that the deflection rollers 3 and the deflection rollers 4 of one side are arranged in substantially a single plane. The axes of the deflection rollers 3, 4 of one side run substantially parallel to each other, and the deflection rollers 3, 4 are arranged substantially at the same height as shown in FIG. 1. Furthermore, the articulation points and contact points of the tension transmitting means 1 on the frame 6 and slide 5 of one side are in a plane with the deflection rollers 3, 4 of the corresponding side as shown in FIG. 1.

When the cylinder 2 moves relative to the rod 7 in a movement to the right in the view in FIG. 1, the slide 5 can move from the position of the cylinder 5 in the frame 6 shown in FIG. 1. The deflection rollers which are securely arranged on the cylinder 2 are used as movable rollers in order to drive the slide 5 similar to a pulley. This force on the slide 5 is one-half as large as the force of the cylinder 2. The slide 5 can travel twice the path traveled by the cylinder 2 relative to the rod 7.

Figure 2:
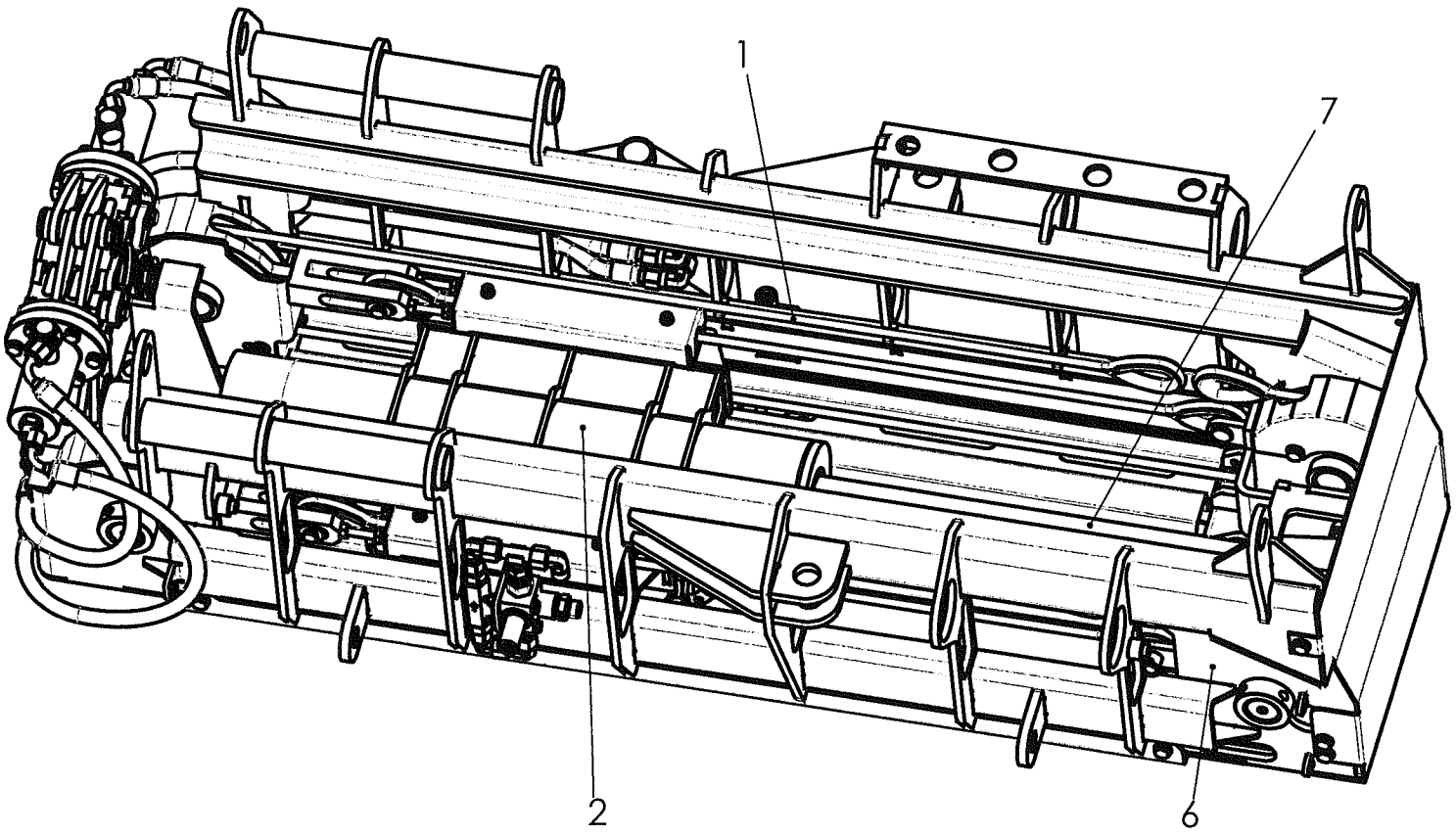
FIG. 2 shows the earth drilling device according to FIG. 1 without a slide and deflection rollers in an isometric representation obliquely from above.

FIG. 2 shows a bird's eye view of the earth drilling device depicted in FIG. 1 without deflection rollers 4 and the slide 5.

What is claimed is:

1. A drive for a feed of a horizontal earth drilling device comprising:

a frame;

a slide moveably mounted to the frame and configured to move a drill string in a direction generally horizontal with respect to a surface of the earth for creating a horizontal drill hole;

an actuator comprising a rod fixedly attached to the frame and a cylinder moveable with respect to the frame;

a first pair of deflection rollers mounted to a first side of the cylinder, each of the first pair of deflection rollers arranged in a common first plane and defining rotational axes that are parallel and offset from one another;

a second pair of deflection rollers mounted to a second side of the cylinder opposite the first side, each of the second pair of deflection rollers arranged in a common second plane and defining rotational axes that are parallel and offset from one another;

a third pair of deflection rollers mounted to the frame in the first plane;

a fourth pair of deflection rollers mounted to the frame in the second plane;

first and second tensioning members guided by the first pair of deflection rollers and the third pair of deflection rollers, each of the first and second tensioning members having a first free end attached to the frame and a second free end attached to the slide; and third and fourth tensioning members guided by the second pair of deflection rollers and the fourth pair of deflection rollers, each of the third and fourth tensioning members having a first free end attached to the frame and a second free end attached to the slide, wherein each portion of the first, second, third and fourth tensioning members extending between the deflection rollers are oriented generally parallel to one another.

2. The drive of claim 1, wherein each of the deflection rollers of the first and second pairs of deflection rollers have a smaller diameter than each of the deflection rollers of the third and fourth pairs of deflection rollers.

3. The drive of claim 2, wherein a ratio of the diameter of each of the deflection rollers of the first and second pairs of deflection rollers to the diameter of each of the deflection rollers of the third and fourth pairs of deflection rollers is between 1:1.3 and 1:1.7.

4. The drive of claim 1, wherein the cylinder is a hydraulic cylinder, and the rod is a piston rod on the hydraulic cylinder.

5. The drive of claim 1, wherein each of the tension members comprise at least one of cables and chains.

6. An earth drilling device having a feed slide for advancing a drill string and a rod, comprising:

a frame;

a slide moveably mounted to the frame;

an actuator comprising a rod fixedly attached to the frame and a cylinder moveable with respect to the frame;

a first pair of deflection rollers mounted to a first side of the cylinder, each of the first pair of deflection rollers arranged in a common first plane and defining rotational axes that are parallel and offset from one another;

a second pair of deflection rollers mounted to a second side of the cylinder opposite the first side, each of the second pair of deflection rollers arranged in a common second plane and defining rotational axes that are parallel and offset from one another;

a third pair of deflection rollers mounted to the frame in the first plane;

a fourth pair of deflection rollers mounted to the frame in the second plane;

first and second tensioning members comprising at least one of cables and chains and guided by the first pair of deflection rollers and the third pair of deflection rollers, each of the first and second tensioning members having a first free end attached to the frame and a second free end attached to the slide; and third and fourth tensioning members comprising at least one of cables and chains and guided by the second pair of deflection rollers and the fourth pair of deflection rollers, each of the third and fourth tensioning members having a first free end attached to the frame and a second free end attached to the slide, wherein each portion of the first, second, third and fourth tensioning members extending between the deflection rollers are oriented generally parallel to one another.

7. The earth drilling device of claim 6, wherein each of the deflection rollers of the first and second pairs of deflection rollers have a smaller diameter than each of the deflection rollers of the third and fourth pairs of deflection rollers.

8. The earth drilling device of claim 7, wherein a ratio of the diameter of each of the deflection rollers of the first and second pairs of deflection rollers to the diameter of each of the deflection rollers of the third and fourth pairs of deflection rollers is between 1:1.3 and 1:1.7.

9. The earth drilling device of claim 6, wherein the cylinder is a differential cylinder.

10. The earth drilling device of claim 6, wherein the cylinder is a hydraulic cylinder.

11. A method for driving a slide arranged in a frame for moving a drill string of an earth drilling device comprising the steps of:

biasing a first pair of deflection rollers and a second pair of deflection rollers within the frame with an actuator comprising a rod fixedly attached to the frame and a cylinder moveable with respect to the frame, the first pair of deflection rollers mounted to a first side of the cylinder in a common first plane and defining rotational axes that are parallel and offset from one another, the second pair of deflection rollers mounted to a second side of the cylinder opposite the first side in a common second plane and defining rotational axes that are parallel and offset from one another;

applying tension on first and second tensioning members, the first tensioning member guided by one of the first pair of deflection rollers and one of a third pair of deflection rollers mounted to the frame in the first plane, the second tensioning member guided by one of the second pair of deflection rollers and one of a fourth pair of deflection rollers mounted to the frame in the second plane; and applying tension on third and fourth tensioning members, the third tensioning member guided by the other one of the first pair of deflection rollers and the other one of the third pair of deflection rollers mounted to the frame in the first plane, the fourth tensioning member guided by the other one of the second pair of deflection rollers and the other one of the fourth pair of deflection rollers mounted to the frame in the second plane, wherein each tensioning member comprises a first free end attached to the frame and a second free end attached to the slide, and wherein each portion of the first, second, third and fourth tensioning members extending between the deflection rollers are oriented generally parallel to one another.

12. The method of claim 11, wherein each of the deflection rollers of the first and second pairs of deflection rollers have a smaller diameter than each of the deflection rollers of the third and fourth pairs of deflection rollers.

13. The method of claim 12, wherein a ratio of the diameter of each of the deflection rollers of the first and second pairs of deflection rollers to the diameter of each of the deflection rollers of the third and fourth pairs of deflection rollers is between 1:1.3 and 1:1.7.

14. The method of claim 11, wherein the cylinder is a differential cylinder.

15. The method of claim 11, wherein the cylinder is a hydraulic cylinder, and the rod is a piston rod on the hydraulic cylinder.

16. The method of claim 11, wherein each of the tension members comprises at least one of cables and chains.

* * * * *